US006422887B1

(12) United States Patent
Myer et al.

(10) Patent No.: US 6,422,887 B1
(45) Date of Patent: Jul. 23, 2002

(54) HIGH DURABILITY, LOW MATING FORCE ELECTRICAL CONNECTORS

(75) Inventors: John Mark Myer, Millersville; James Michael Raudenbush, Halifax; John Raymond Shuey, Mechanicsburg, all of PA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 09/704,332

(22) Filed: Nov. 2, 2000

Related U.S. Application Data

(60) Provisional application No. 60/163,201, filed on Nov. 3, 1999.

(51) Int. Cl.[7] ..... H01R 11/22
(52) U.S. Cl. ..... 439/268
(58) Field of Search ..... 439/268, 261, 439/263, 266, 353, 357, 725, 441, 331

(56) References Cited

U.S. PATENT DOCUMENTS

| | | | | |
|---|---|---|---|---|
| 4,047,791 | A | 9/1977 | Carter | |
| 4,067,633 | A | 1/1978 | Groft et al. | |
| 4,118,093 | A | 10/1978 | Obeissart | 339/75 M |
| 4,350,402 | A | 9/1982 | Douty et al. | |
| 4,491,377 | A | 1/1985 | Pfaff | |
| 4,618,199 | A | 10/1986 | Pfaff | |
| 4,655,526 | A | 4/1987 | Shaffer | |
| 4,684,194 | A | 8/1987 | Jenkins et al. | |
| 4,685,886 | A | 8/1987 | Denlinger et al. | |
| 4,787,866 | A | 11/1988 | Morningstar et al. | |
| 4,978,315 | A | 12/1990 | Edgley et al. | |
| 4,984,993 | A | 1/1991 | Neumann et al. | |
| 5,061,197 | A | 10/1991 | Kuzuno et al. | 439/262 |
| 5,254,012 | A | 10/1993 | Wang | |
| 5,362,248 | A | 11/1994 | Hashiguchi | |

OTHER PUBLICATIONS

European Search Report, Application No. EP00309747, completion of search 10 Sep. 2001.

*Primary Examiner*—Renee Luebke
*Assistant Examiner*—Felix O. Figueroa

(57) ABSTRACT

An electrical connector assembly includes a female connector and a male connector, wherein the female connector comprises a first connector piece adapted to retain female terminals therein and a second connector piece having internal camming projections; the first and second connector pieces being disposed for relative movement such that, upon movement of the second connector piece towards the first connector piece by actuation of external camming members, the internal camming projects deflect spring contact members on the female terminals, whereby the force needed to mate or unmate male terminals with the female terminals is reduced.

17 Claims, 9 Drawing Sheets

FIG. 9
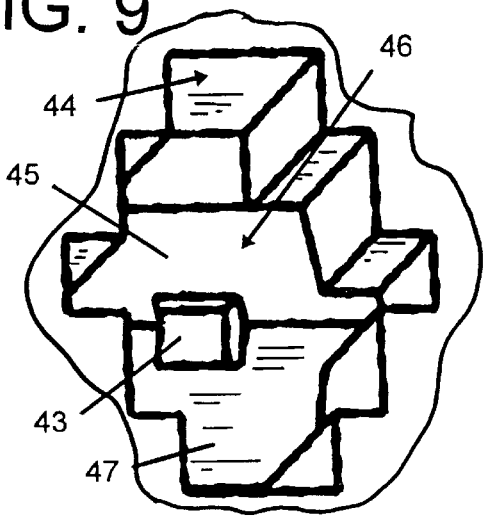
FIG. 11
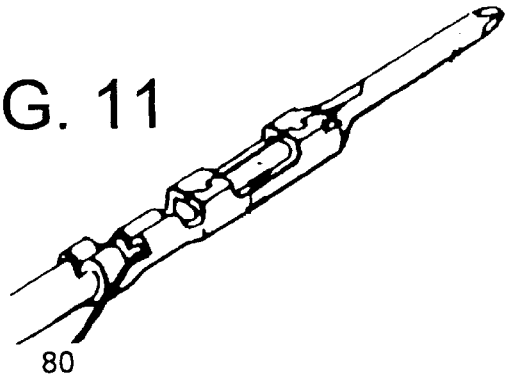
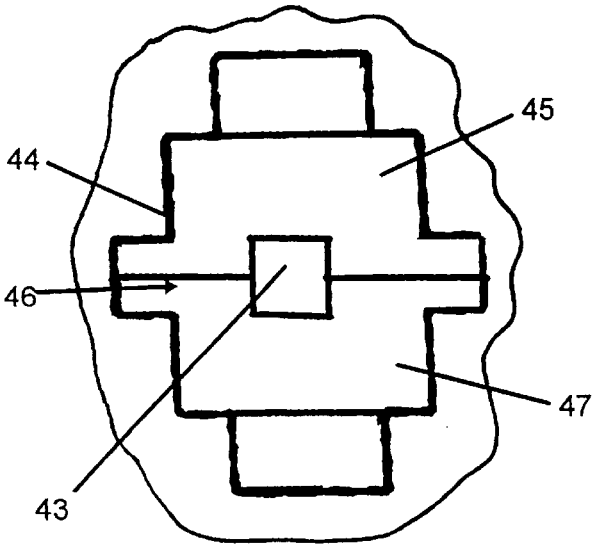
FIG. 10

HIGH DURABILITY, LOW MATING FORCE ELECTRICAL CONNECTORS

This Appln claims benefit of Prov. No. 60/163,201 filed Nov. 3, 1999.

BACKGROUND OF THE INVENTION

1. Field of the Invention

This invention is related to matable electrical connectors in which spring beam terminals in one of the connectors are deflected prior to mating engagement with terminals in the other connector to reduce the mating force and to enhance the durability of the terminals and of the plating on the terminals.

2. Brief Description of the Prior Art

Zero insertion force (ZIF) or low insertion force (LIF) electrical connectors or sockets typically employ some form of cam member to reduce or eliminate the insertion force as two electrical connectors are mated. These connectors are typically used to reduce or eliminate the frictional force between mating male and female terminals. This frictional or mating force can result in damage to the terminals and to the electroplating used to ensure an good electrically conductive interface. High mating forces can also reduce the number of mating and unmating cycles for which specific terminals can be employed. Terminals and connectors that have distinct advantages for certain applications cannot be used for potentially related applications in which the connectors must be mated or unmated more frequently because of damage to the mating interface. Conventional ZIF or LIF connectors have been used in applications of this type, but one problem is that prior art ZIF or LIF connectors require a separate camming member that must be actuated as an additional step in the mating and unmating process. These additional camming members and rotary or linear actuators also add an additional component requiring additional space and generally resulting in additional cost.

Many prior art ZIF or LIF electrical connectors are used in sockets for integrated circuit components. Others are used to connect wires to pins on printed circuit boards. U.S. Pat. No. 4,350,402 discloses one such board mounted zero insertion force electrical connector in which female terminals are located in an inner housing and an outer housing includes inclined actuating surfaces for spreading the contact beams when the outer housing is shifted relative to the terminals and to the inner housing. A linear cam is used to impart movement between the two housings resulting in separation of opposed contact arms. U.S. Pat. No. 4,067,633 also employs two shiftable housings and inclined contact actuating surfaces on the housing that moves toward the mating ends of the spring contacts. This latter connector employs external handles on the connector attached to wires. When these handles are pressed together the terminals are moved forward to spread the contacts so that pins on a printed circuit board can be inserted between the contact arms without significant frictional mating force. One problem with this approach is that the terminals can still be forced into engagement with the pins without first separating the female spring beam, thus resulting in damage to the contact interface.

Each of these prior art approaches requires and additional cam actuating step to mate the connectors. U.S. Pat. No. 4,655,526 discloses another low insertion force electrical connector in which spring beams are initially held in a partially open position and are then released when two connectors are mated. However, this approach requires a complicated contact structure including insertion of a coil spring between spring beams. This contact structure differs significantly from standard contacts that have proved reliable in may applicatons.

Another approach is to partially preload spring beam terminals so that the mating force is reduced. An example of one such approach is shown in U.S. Pat. No. 4,685,886. Although this approach has advantages it eliminates only part of the mating force and it is typically used to reduce mating force to insure complete connection and not necessarily to increase the number of mating cycles.

SUMMARY OF THE INVENTION

The instant invention overcomes many of these disadvantages by providing an electrical connector in which mating force is significantly reduced in a configuration in which the connectors are mated by simply inserting one connector into another without manipulation of a separate cam actuator. This invention permits standard female or receptacle terminals, that are typically intended to be used for a limited number of mating and unmating cycles to be employed in applications requiring many more mating cycles. One of the objects of this invention is to permit standard receptacle terminals that are commonly used in automotive applications as input and output terminals for attaching other components or appliances to the vehicle electrical system. For example, this approach will allow portable electronic devices to be repeatably connected and disconnected to an electronic bus in the vehicle. Another object achieved by invention is to provide this capability without significant cost disadvantages and without requiring numerous additional components while still being relatively easily molded.

The advantages of this invention are also not limited to motor vehicle applications. This invention can be employed in numerous applications including printed circuit board connectors, integrated circuit component sockets, and wire to wire connectors.

One especially significant advantage of this invention is that the two connectors cannot be mated or unmated without first deflecting spring beam terminals so that male terminals can be inserted or removed without damage to the contact interface and to the plating on the terminals.

This electrical connector assembly also incorporates by a cam actuation function and a connector latching function. Disengagement of the connector latch also separates the terminal mating interface so that the connectors can be unmated without damage to the terminals.

These and other advantages are achieved by an electrical connector assembly including first and second mating electrical connectors. The first electrical connector includes first and second housings and female terminals. The first housing includes cavities with the female terminals secured in the cavities and a deflectable camming lever. The second housing includes camming surfaces engageable with the female terminals to open the female terminals. The second electrical connector includes a mating housing and male terminals insertable into mating engagement with the female terminals. The mating housing includes a surface engagable with the camming lever during mating to deflect the camming lever and shift the second housing relative to the first housing and open the female terminals for insertion of the male terminals.

The first electrical connector has a molded housing with a molded latch engagable with the second electrical connector to latch the connectors in a mating position. The molded latch includes a camming surface for shifting a portion of the first electrical connector relative to the molded housing as the first and second electrical connectors are mated.

The first electrical connector of this assembly has a front mating face and a rear face. The terminals in this first connector have a deflectable spring contact section. A rear housing in this first connector includes cavities in which the terminals are secured. A front housing telescopes relative to the rear housing between a first forward and a second relative rearward position. The front housing has a front panel with a plurality of openings and camming projections on an interior surface of the front panel located adjacent the openings and facing rearward. A camming member is located adjacent to the front mating face of the connector. Deflection of the camming member brings the camming member into engagement with the front housing and moves the front housing toward the second relative rearward position and toward the contacts to bring the camming projections into engagement with the spring contact sections to deflect the spring contact sections. The second electrical connector includes a housing abutting the camming member when mated with the first electrical connector to deflect the camming member to cause deflection of the spring contact sections.

BRIEF DESCRIPTION OF THE DRAWINGS

FIG. 9 is an enlarged view of one of the cam openings in the front housing when viewed from the rear or interior of the front housing.

FIG. 10 is a rear view of one of the cam openings shown in FIG. 9 in which the side surfaces shown in the three dimensional representation of FIG. 10 are not seen so that the shape of the cam openings is more clearly revealed.

FIG. 11 is a view of a standard pin or male terminal that could be used in the plug connector.

DETAILED DESCRIPTION OF THE PREFERRED EMBODIMENT

Figure 1:
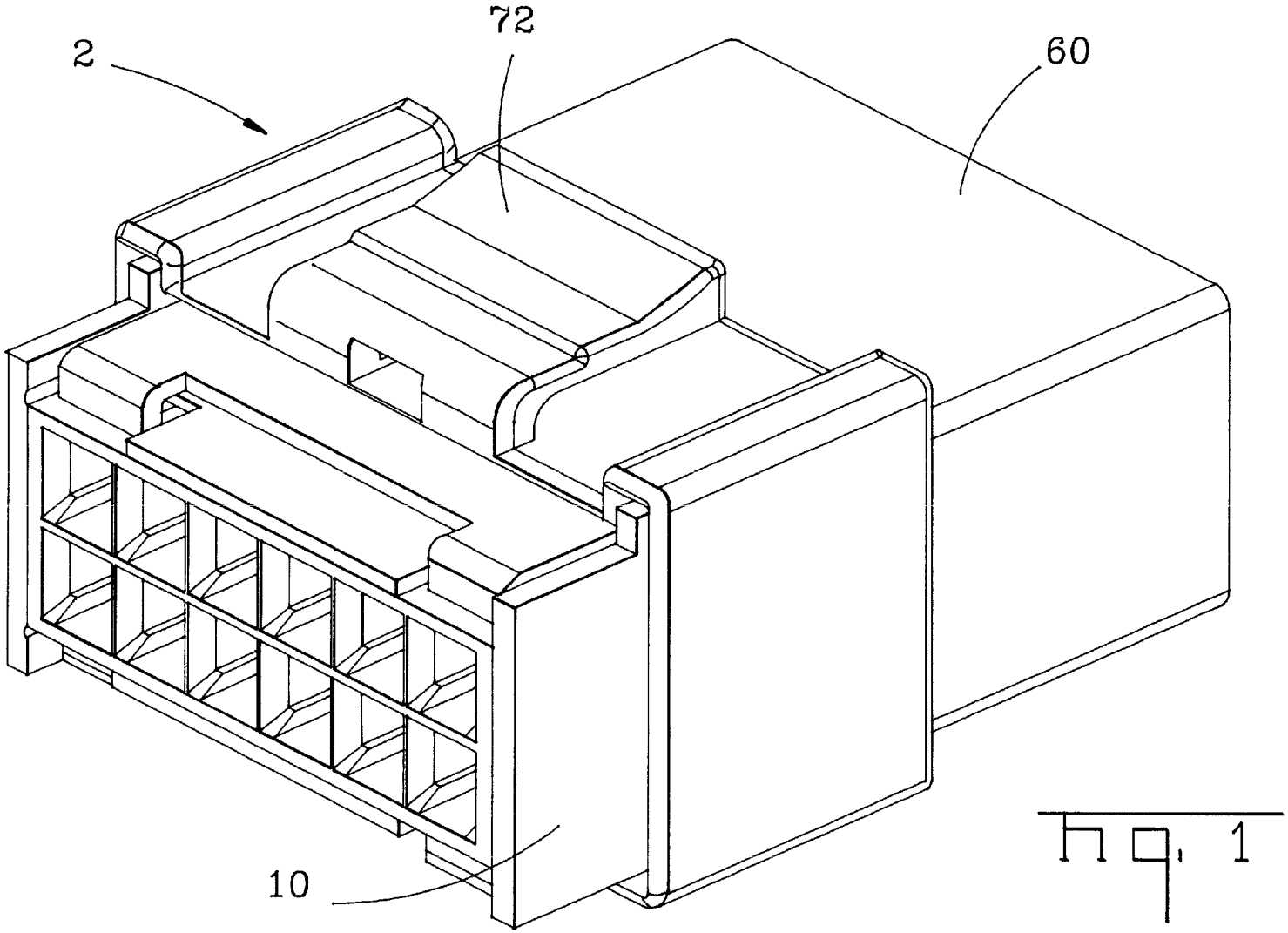
FIG. 1 is a view of a mated electrical connector assembly including first and second connectors. Wires or other conductors, which would extend from the electrical connectors, have been omitted for the sake of clarity.

The electrical connector assembly 2, shown in FIG. 1, includes a first electrical connector 10 mated to a second electrical connector 60. The first electrical connector 10 is a receptacle connector and includes a number of female contacts or terminals 50, shown in FIG. 7. The second electrical connector 60 is a plug connector that includes a plurality of pins 80 of conventional type, such as those shown in FIG. 11, or other conventional male terminals or leads. In order to reduce the mating force and to increase the durability of the mating terminals, and of the plating on these terminals, the first connector 10 includes a shiftable cam 40 in the form of a front housing member that deflects or spreads the spring beam contact section 52 on female terminals 50 as the pins are inserted between the spring beam contact sections 52. When the second connector 60 is fully mated with the first electrical connector 10, the spring beam contact sections 52 are released to engage the pins 80 to establish an electrical connection between mating terminals. The shiftable front housing cam 40 can also be moved into engagement with the spring beam contact sections 52 to disengage the spring beam contacts 50 from the pins 80 when the connectors 10 and 60 are to be unmated. This camming action permits many more mating and unmating cycles than would typically be possible for the contact in question and for the plating on the mating sections of these terminals.

Figure 2:
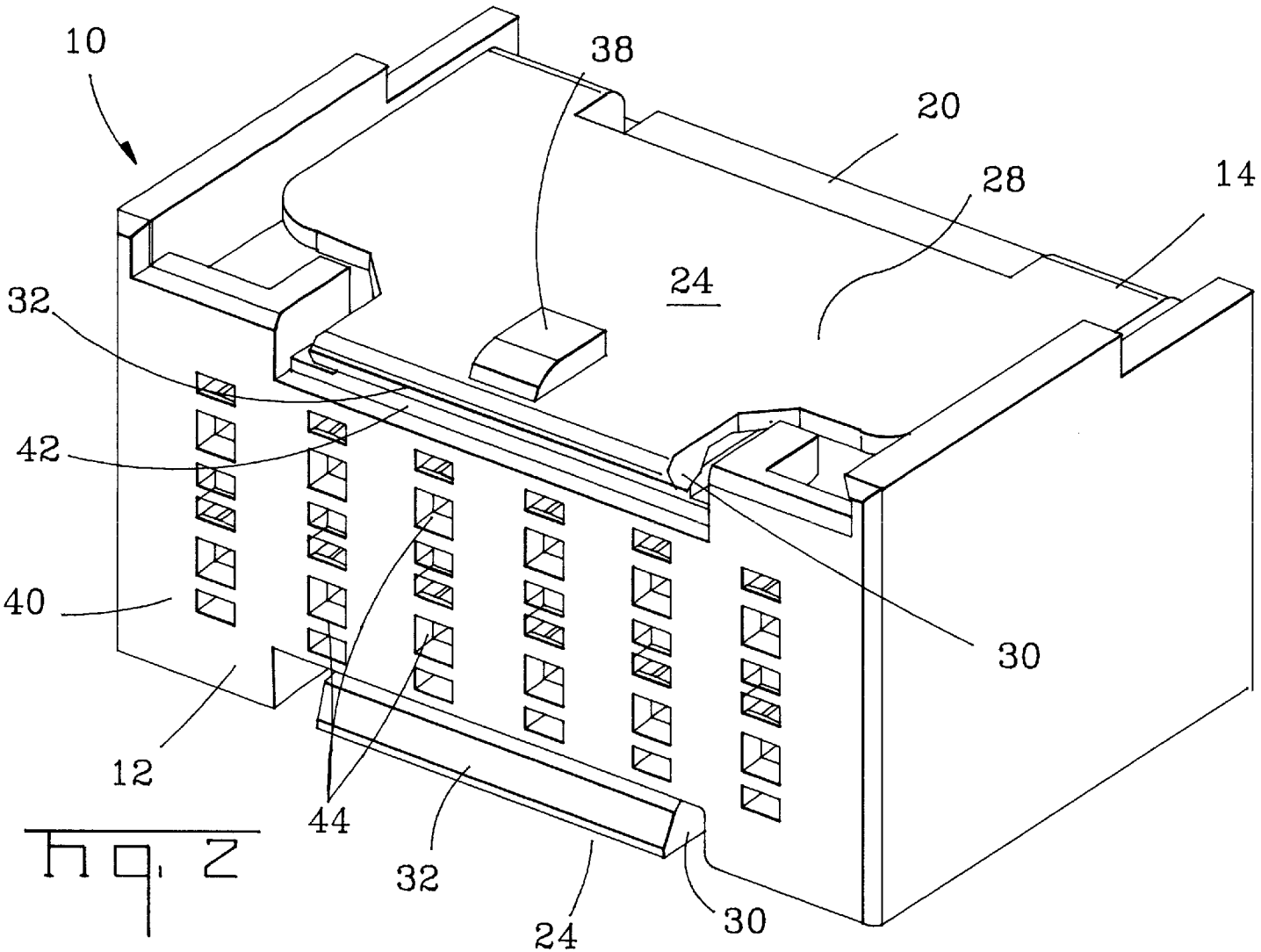
FIG. 2 is a view of a receptacle electrical connector that would include female terminals.
Figure 3:
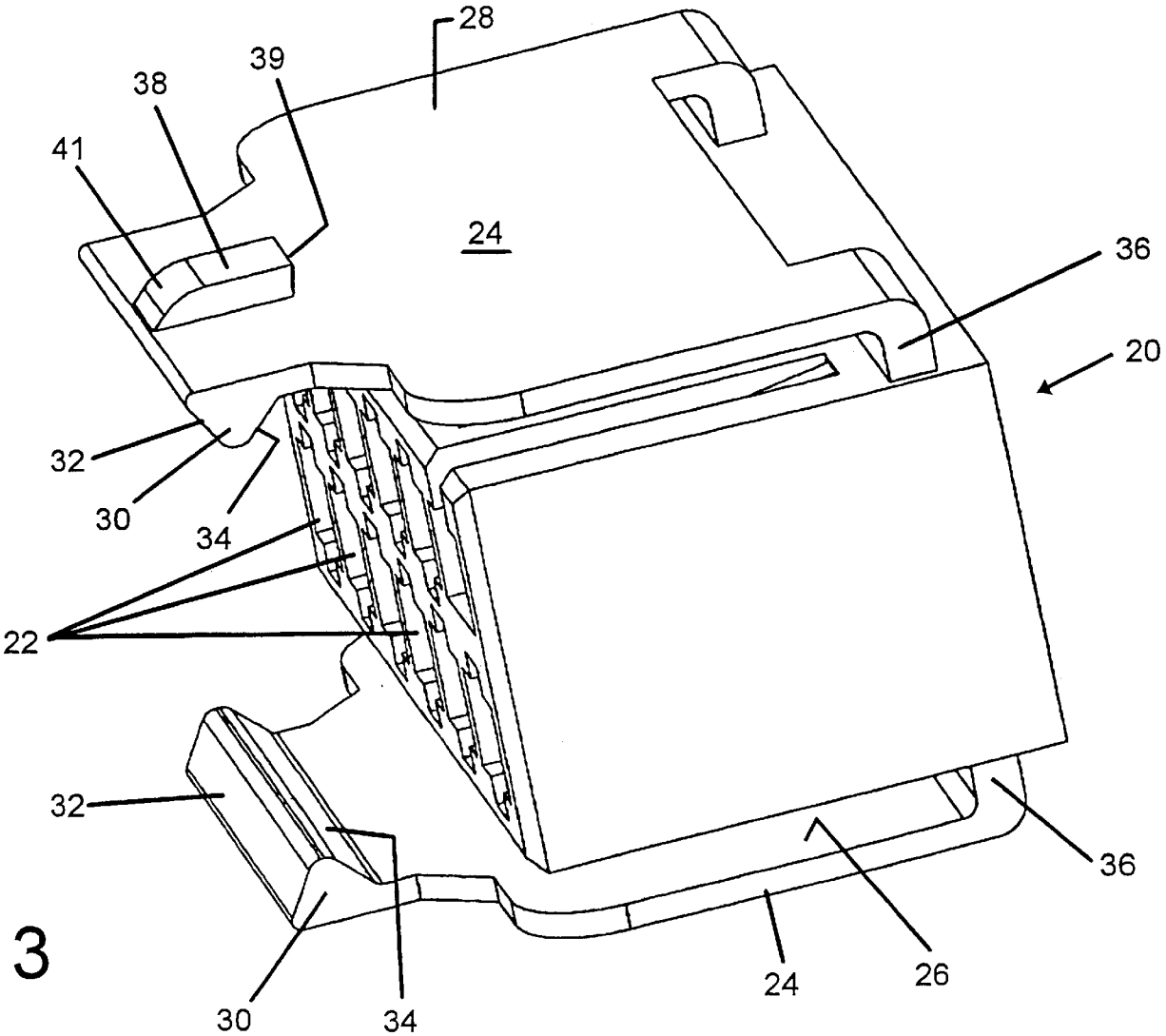
FIG. 3 is a view of the rear housing, one of the subcomponents of the receptacle electrical connector shown in FIG. 2.
Figure 7:
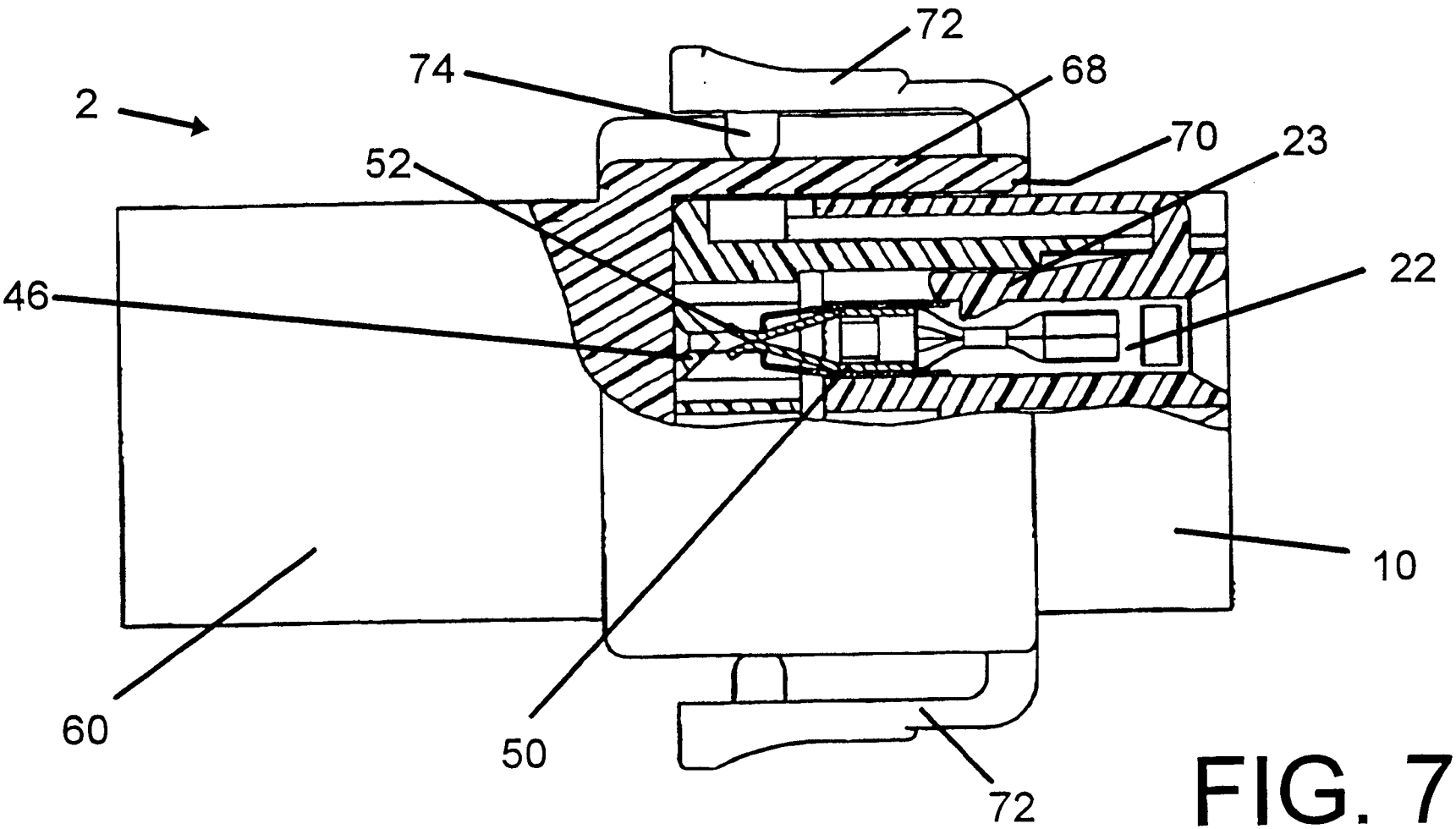
FIG. 7 is a sectional view showing two fully mated electrical connectors. One of the female spring beam receptacle terminals is shown. A camming projection used to spread spring beam contacts and reduce the mating force when pins are inserted into the female terminals as the two electrical connectors are mated is also shown. Pins in the plug connector have been omitted for the sake of clarity.

The receptacle connector 10, as shown in FIGS. 2 & 7, includes a two part housing with female or receptacle terminals 50 mounted in the connector 10. The rear housing 20, shown in FIG. 3, includes terminal cavities 22 extending forward from the rear face or end 14 of the first electrical connector 10. In the representative embodiment, there are two parallel rows of cavities 22. Molded terminal latches 23 extend from the molded housing 10 into each of the terminal cavities 22 and secure the female terminals 50, as shown in FIG. 7. These deflectable molded latches 23 permit insertion of the terminals 50 through the rear end 14, and engage the terminals 50 to prevent retraction of the terminals. These molded latches 23 are conventional and are used in many electrical connectors, especially those used in automotive applications. It should be understood, however, that other means could be employed to secure the terminals 50 in cavities 22. For example, conventional deflectable tabs extending from the terminals themselves could be employed to engage shoulders in the terminal cavities. FIG. 7 however shows that the mating or contact section 52 extends beyond the rear housing 20 and beyond a front end of the terminal cavities 22 in housing 20. The spring beam contacts forming the contact section 52 are exposed on the front of the housing 20. As will be subsequently discussed, these spring beam contact 52 are positioned to enter openings in the front housing 40 so that the spring beam contacts 52 can be outwardly deflected for receiving mating pins or male terminals 80.

The preferred embodiment of the rear housing 20 is molded as one piece. In addition to the terminal latches 23, there are two exterior camming members 24 extending from opposite sides of the rear housing 20. These camming members are also molded as a part of the one-piece housing 20. Each camming member 24 is molded as a cantilever beam with the cantilever beam base 36 joined to the main body of the rear housing 20 adjacent the rear face 14 of the receptacle connector 10. Each cantilever beam camming member 24 extends toward the front or mating housing end 12. A camming protrusion 30 extends from the inner surface 26 adjacent the free or distal end of the cantilever camming member 24. This camming protrusion 30 faces inward and is located beyond the forward most part of the body of the rear housing 20. Camming protrusions 30 on the two camming members 24 extend from the top and bottom sides of the rear housing 20 as viewed in FIG. 3. Each camming protrusion 30 has an inclined leading edge or face 32 and an inclined trailing edge or face 34 so that the camming protrusions 30 have a generally triangular cross section. These inclined faces 32 and 34 are sloped so that a surface engaging either face during mating and unmating or the two connectors 10, 60, or during assembly of the two connector housings 20, 40, will slide along the sloping surface and outwardly deflect the two camming members 24.

Each of the camming members 24 also includes a latching protrusion 38 extending from the outer surface 28 adjacent to its distal, forward or free end. One latching protrusion 38 is located near the center of each of the camming members 24 and the width of the latching protrusions 38 is less than the width of the camming protrusions 30 on the same camming member 24. The latching protrusions 38 have a curved forward end 41 and an abruptly sloping rear end 39. The curved forward end 41 is configured to engage a surface on the mating connector 60 during mating to deflect the camming member 24 and the camming protrusion 30 inward. The shape rear edge 42 is intended to form a latching surface to hold the two connectors 10, 60 securely mated. Each camming member 24 thus serves both as a connector latching member and to cam the spring beam contact sections 52 in a manner that will be discussed in greater detail. Camming member 24 can therefore also be referred to as a camming lever 24, a camming latch 24, or a molded latch 24. In the preferred embodiment the structure of the camming member 24 can also be termed a cantilever beam 24 or a camming arm 24.

The front housing 40 is secured to the rear housing 20 by the camming latches 24. Front housing 40 is shown in greater detail in FIGS. 4 and 5. The front housing, which is also a one piece molded member, is assembled to the rear housing 20 after the female terminals 50 have been inserted into appropriate terminal cavities 22 from the rear of the rear housing 20. The front housing 40 has four sidewalls all joined along a forward edge to a front wall or panel 48. Rear housing 20 is inserted into the front housing 40 through the open rear of housing 40 with the four sidewalls enveloping the front portion of the rear housing 20. Since the camming arms 24 are spaced from adjacent walls of the rear housing 20, the top and bottom sidewalls of the front housing can be inserted between the camming arms 24 and the top and bottom of the rear housing 20. When the front housing 40 is fully assembled on the rear housing 20, the trailing edge 34 of the adjacent camming protrusion 30 will engage a front edge 42 of the front housing 40 along the top and bottom of the front panel 48. The camming protrusions 30 will thus hold the front housing 40 on the rear housing 20. It is important to note, however, that telescoping movement of the front housing 40 relative to the rear housing 20 is still possible. The front housing 40 can move from its forward position shown in FIG. 2, rearward relative to the rear housing 20 and to the female terminals 50, which are prevented from rearward movement relative to the rear housing 20 by the molded terminal latches 23.

Figure 5:
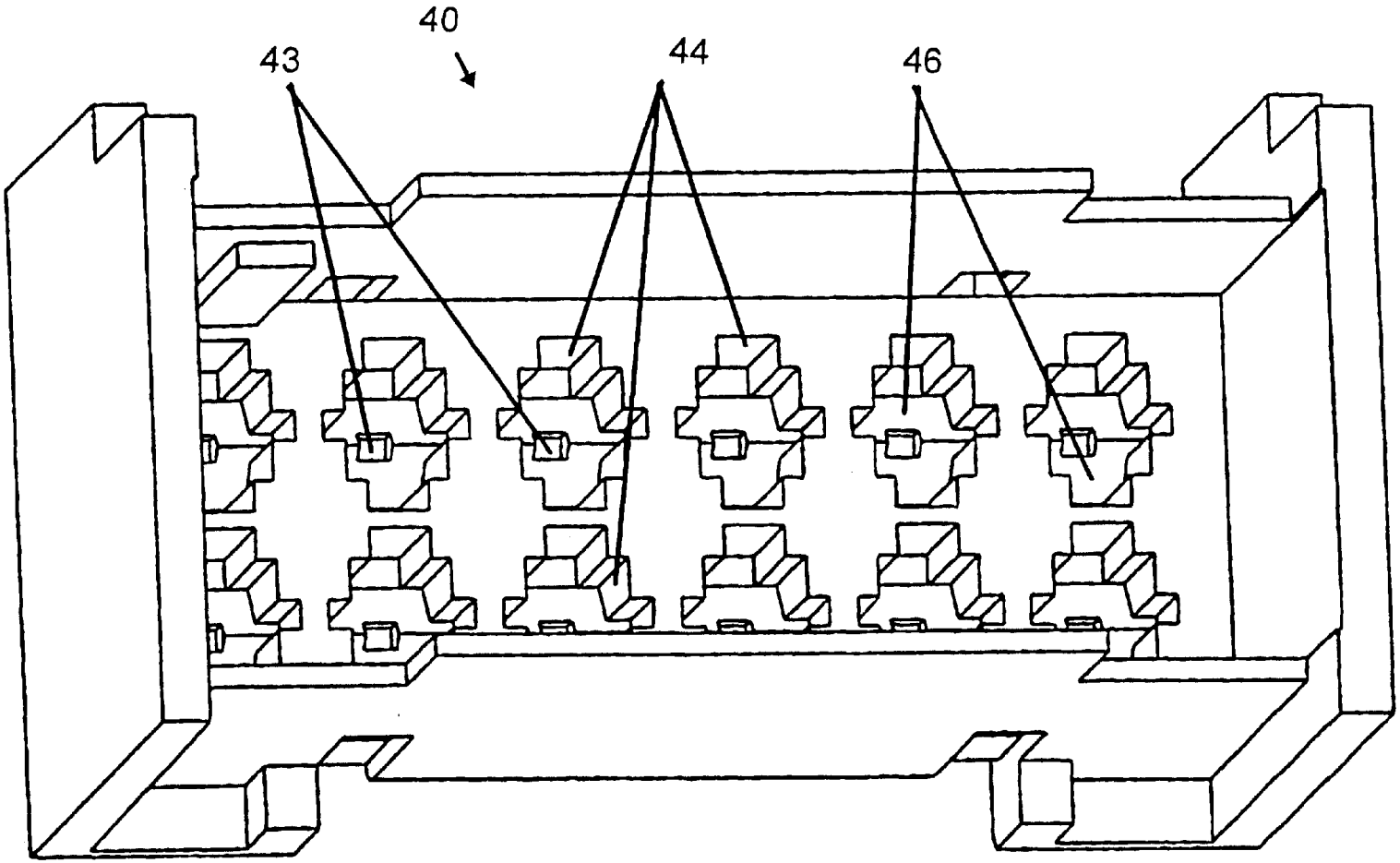
FIG. 5 is a rear view of the front housing, shown in FIG. 4, showing camming projections adjacent to openings in the front panel of the front housing.

FIG. 5 shows the interior or rear side of the front housing 40. The four sidewalls and the front wall or panel 48 form a cavity in which the front portion of the rear housing 20 is received. A series of camming openings 44 are formed in the front panel 48. Each of these openings 44 is aligned with a terminal cavity 22 in the rear housing 20, and each opening is configured so that the front of the mating terminal section 52 fits within an aligned opening 44. An enlarged view of one of these terminal openings 44 is shown in FIG. 9. Other aspects of the structure of a terminal opening 44 are shown in FIG. 7. FIG. 10 is a rear view of one of these openings 44 in which the outer edges of an opening 44 are show. The interior surfaces which appear in FIG. 9 appear as lines in this view.

Figure 4:
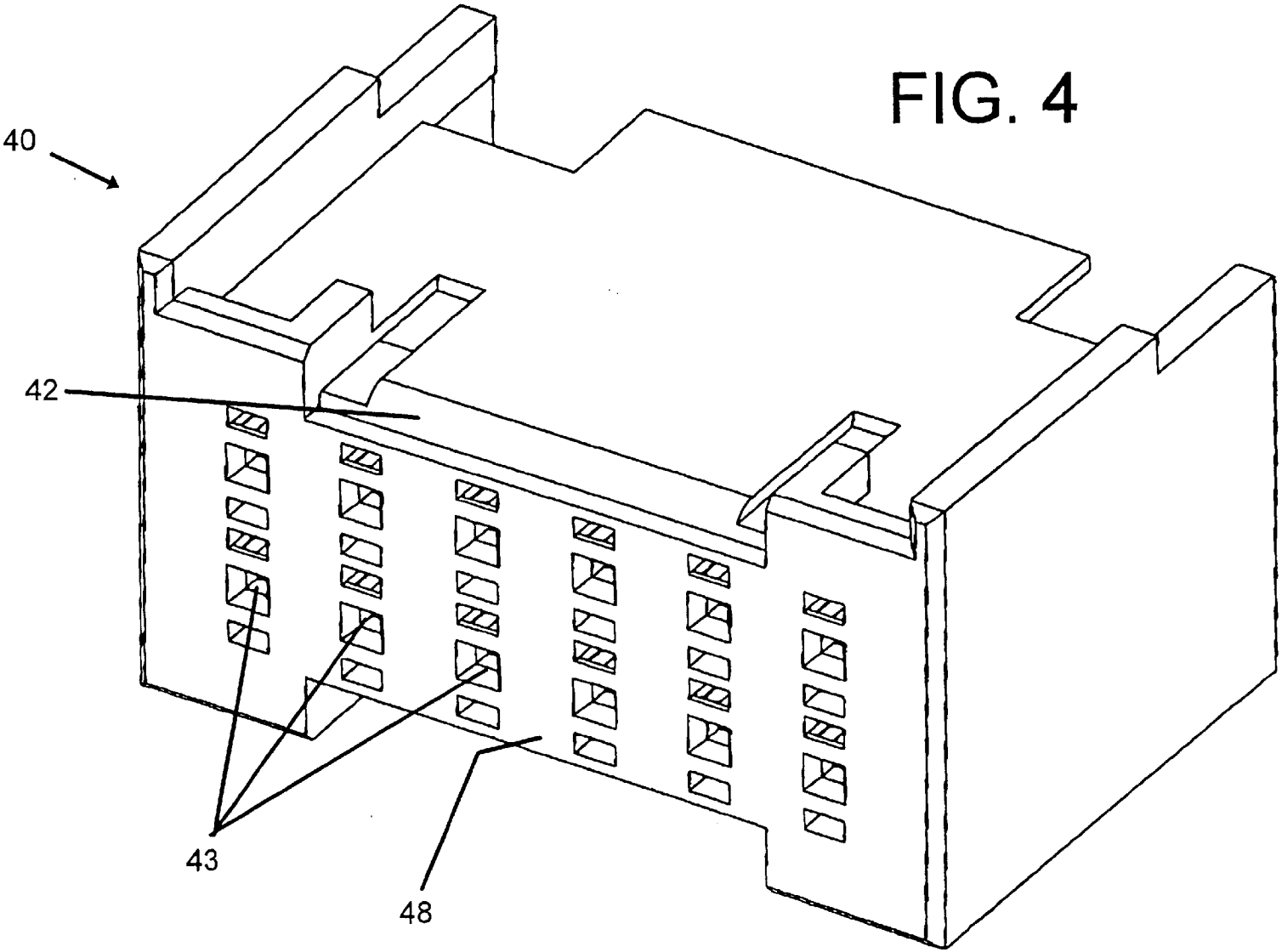
FIG. 4 is a front view of the front housing, a second subcomponent of the receptacle electrical connector shown in FIG. 2, which is shiftable relative to the rear housing shown in FIG. 3.

Each terminal opening 44 is larger at its rear than at its front. A small opening 43 extends completely through the front panel 48 so that a pin 80 in the mating connector 60 can pass through the front housing 40 to mate with a corresponding female terminal 50. Sloping camming projections 46 surround the opening 43. These camming projections slope rearwardly toward an apex located generally along the horizontal centerline of both the opening 44 and the smaller pin opening 43 in the manner best seen in FIG. 7. Each camming projection 46 has a sloping top surface 45 and a sloping lower surface 47 as seen in FIG. 9. Each camming projection 46 is configured to fit between the upper and lower spring beams of the receptacle terminal mating section 52 of one receptacle terminal 50. Each opening 44 is dimensioned so that the front mating portion 52 will fit within the rear portion of the opening 44. As the front housing 50 moves rearward the camming projections 46 will engage the spring beams of the terminal 50 forcing them apart so that a male terminal or pin 80 can be inserted between the spring beams either with no mating force generated by the engagement of the male and female terminals or with a reduced mating force. This reduction in mating force will not only prevent damage to the physical structure of the terminals, but will also prevent damage to the electroplating added to the terminals to improve the mating interface. Reduction in mating force will also permit the terminals to be mated and unmated for significantly more cycles than would be possible for an otherwise comparable full force mating configuration. Adequate space at the top and bottom of each opening 44 is provided to permit the spring beams to flex outward. As seen in FIG. 4, openings may be provided above and below the pin openings 43 so that the terminals can be probed from the front to check for continuity. These probe openings provide access to the terminal 50 when the connector 10 is mounted in a panel or bulkhead and would otherwise be inaccessible.

Figure 6:
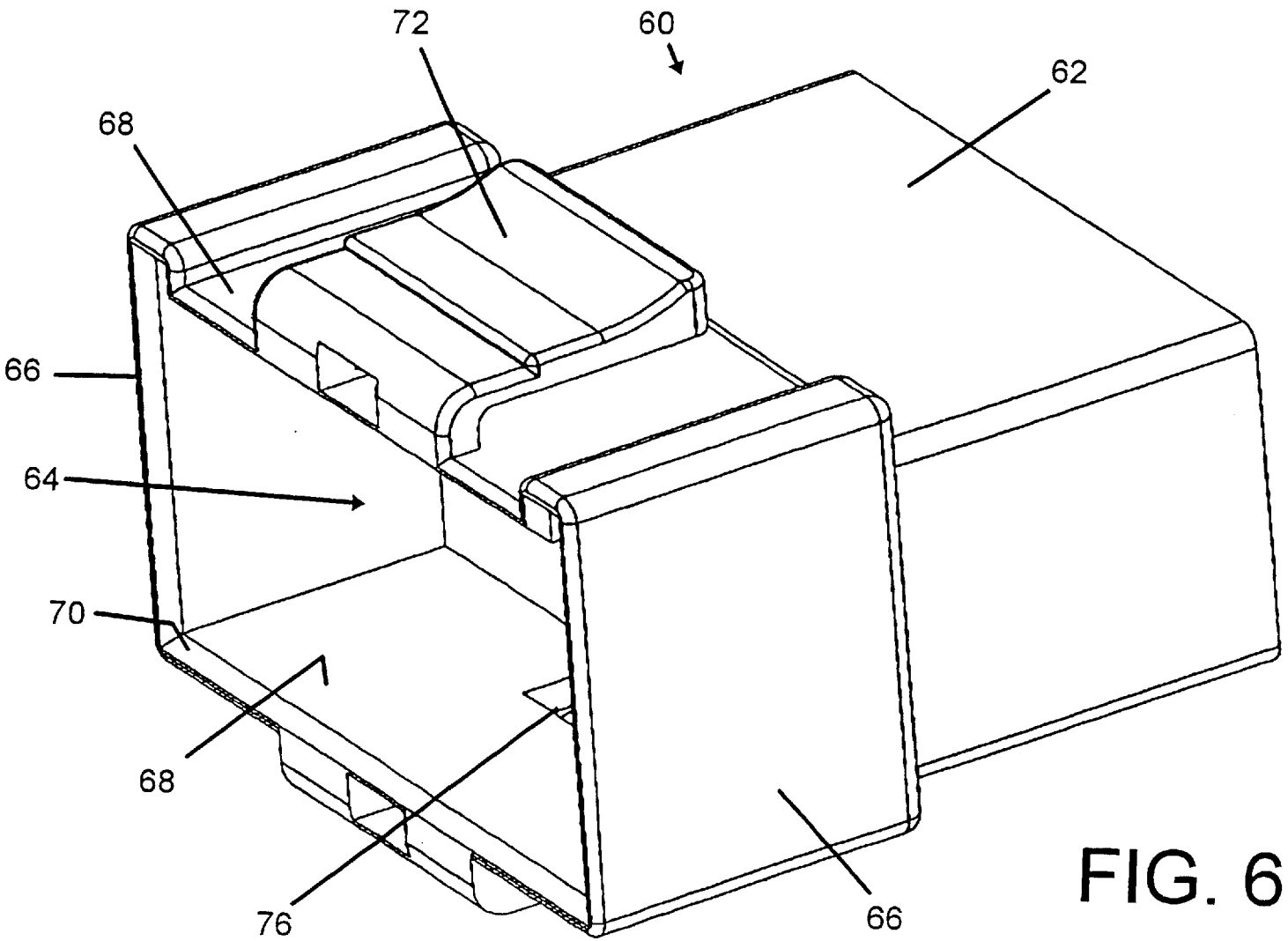
FIG. 6 is a view of the plug connector housing, one of the subcomponents of the second electrical connector matable with the first electrical connector shown in FIG. 2.

The front housing 40 can also be referred to as a cam or cam insert or cam actuator since movement of the front housing 40 toward the rear housing 20 cams the terminal mating sections 52 outward. Rearward movement of the front housing 40 relative to the rear housing 20 is imparted by inward deflection of the camming members 24 and the camming protrusions 30. When the camming members 24 is inwardly deflected, the camming protrusions 30 engage the front edge 42 of front housing 40 causing it to move rearwardly from the front position shown in FIGS. 2 and 7. When the plug connector 60 is mated to the receptacle connector 10, the camming protrusions 30 will result when the plug connector housing 62 engages the camming members 24. The male or plug connector housing 62 is shown in FIG. 6. Together with the male terminals or pins 80, this housing 62 forms the plug or male connector 60. Plug connector housing 62 is molded, normally from the same material as the two housings 20 and 40, which are part of the receptacle connector 10. A plug housing cavity 64 is formed on the mating side of the plug housing 62 by a shroud formed for four walls, two sidewalls 66 and top and bottom walls 68. Male terminals or pins 80 extend into the cavity 64, which is shaped so that the mating end 12 of connector 10 will fit within the cavity 64. When the two connectors are mated the top and bottom walls 68 function as engaging surfaces which abut the outer latching protrusions 38 on the camming members 24 to cause the inner camming protrusions 30 to engage and shift the front housing 40 rearwardly toward the rear housing 20 and into engagement with the female spring beam terminals 50. The front edge of each wall 68 has a beveled surface 70, which initially engages the latching protrusion 38 so that the connectors can be smoothly mated.

Figure 8:
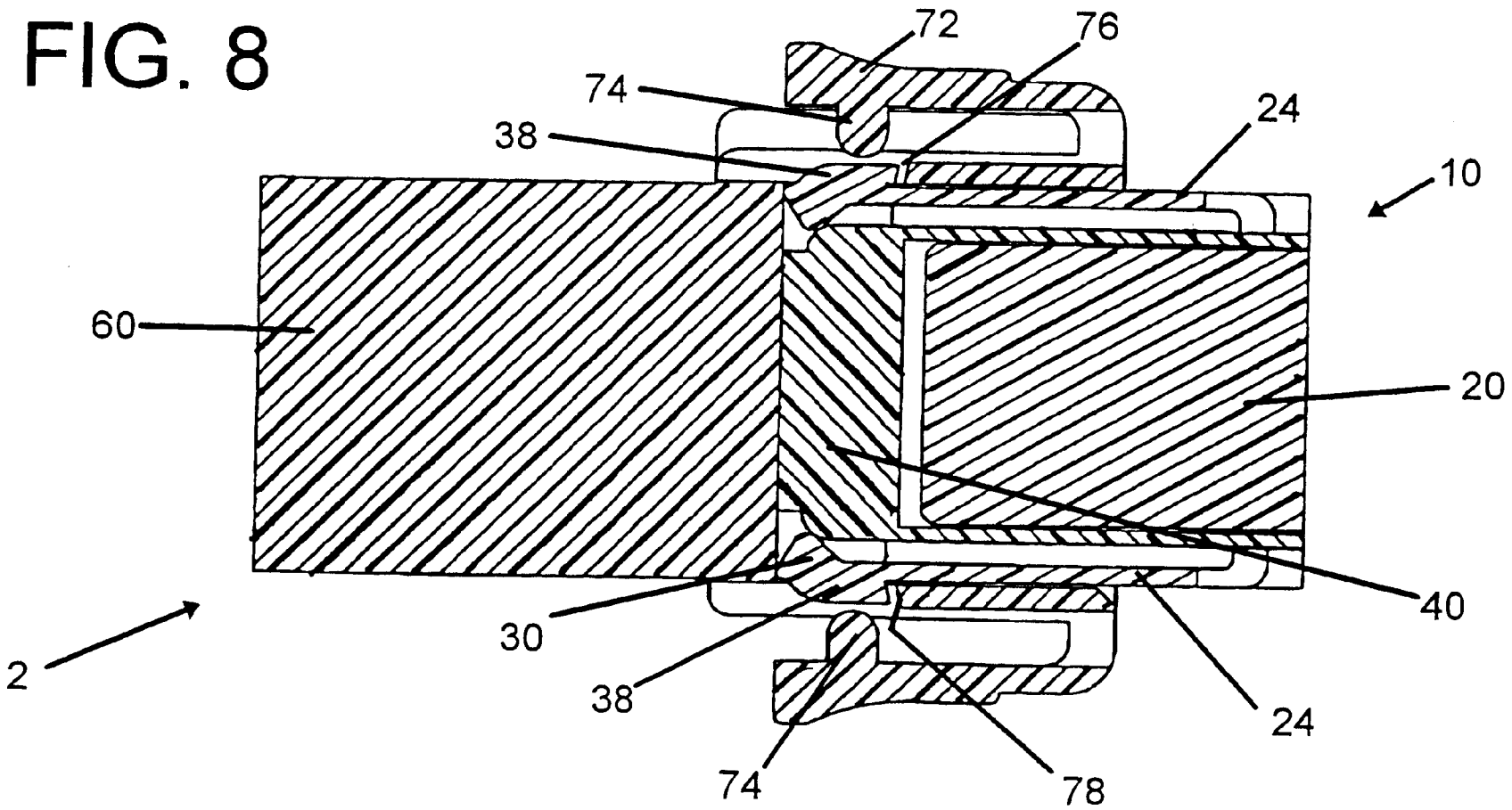
FIG. 8 is another sectional view of the mated connectors showing the camming member or camming latch as it engages the shiftable front housing which acts as a cam, as well as the release member on the plug connector housing.

The walls 68 engage the outer latching protrusions 38 only in the initial part of the mating movement of the two connectors relative to each other. Thus the camming lever 24 and protrusion 30 are held in their cammed position for only the first part of this insertion. Each housing wall 68 includes an opening 76 that is at least as large as the latching protrusion 38. One of these openings 76 is partially shown in FIG. 6, and FIG. 8 shows both latching protrusions 38 received within a latching opening 76. Latching edge 39 engages a latching edge 78 in the wall opening 76 of the plug connector 60. The latching opening 76 on the top wall 68 is obscured in FIG. 6 by the top depressible release member or appendage 72. Openings 76 are recessed from the leading edge of walls 68 and from the beveled surface 70 along this leading edge. After the camming levers 24 have been inwardly deflected or depressed by the walls or surfaces 68 on the male connector housing 62, continued movement of the plug connector 60 to its fully mated configuration, shown in FIGS. 1, 7 and 8, will release the camming lever 24 when the latching protrusions 38 are aligned with the openings 76. When so aligned the camming levers 24 will pivot back to their normal or neutral position, releasing the front housing or cam actuator 40 to move away from the rear housing 20. The spring beam contacts 52, initially spread apart by the camming projections 46 are then free to deflect back into engagement with the pins 80 which have now been inserted between the two spring beams forming contact sections 52.

In the preferred embodiment of this invention, the spring beams themselves provide the spring force necessary to cause the front housing 40 to its forward on extended position. In this extended position the camming projections 46 do not exert any significant force on the terminal spring beams and do not interfere with the mating engagement between female terminals 50 and male terminals 80. In other embodiments of this invention, an auxiliary spring or springs can be added to push the front cam 40 back to its extended position, In still other embodiments sufficient spring force may be provided by relying on only a portion of the resilient contacts to return the front cam to its extended position. In this context, it should also be understood that in some applications only a portion of the terminals need be cammed open in the manner discussed herein.

The male connector 60 provides means for zero or reduced force unmating as well as for mating. The housing 62 includes a depressible or deflectable release member 72 on the exterior of the top and bottom walls 68. These release members 72 are molded as part of the housing 62. Each release member 72 includes a release probe 74 in the form of a finger extending inwardly from the inner surface of the depressible member 72. These release probes or fingers 74 are located immediately above the openings 76 in the walls 68. When the release members 72 are depressed, the release probes 74 engage the latching protrusions 38 and force or cam the camming levers 24 to their inner or activated position. The camming protrusions 30 again engage the front edge 42 of the front housing or cam actuator 40 resulting in deflection of the spring beam contact sections 52 away from pins 80. The pins 80 can then be removed from the female contacts 50 without damage to either mating contact surface or terminal.

One significant advantage of this approach is that mating terminals that are normally suitable for a relatively small number of full force mating and unmating cycles can now be used for many additional cycles. Thus terminals that have performed effectively in applications where the terminals are disconnected only in unusual circumstances, such as servicing of other components or an assembly, can now be used where various components are typically connected or disconnected with relative frequency. For example, terminals that are used in conventional automotive applications can be used as input and output terminals for electronic components that can be connected and disconnected to the motor vehicle electrical system or to electronic busses in the motor vehicles. The proven advantages of these terminals in assembling automotive harnesses and assemblies can then be employed in this new manner.

This configuration also allows the terminals to be mated in a conventional manner without the necessity of rotating or shifting a separate cam lever. The cam housing 40 is shifted as the plug connector is mated to the receptacle connector in a conventional manner. Furthermore, it is now possible to mate the plug connector 60 to the receptacle connector 10 without deflecting the camming lever. The connectors can also be mated by movement of only one connector while the other connector remains stationary. For example, the receptacle connector can be mounted in a panel or bulkhead opening and secured by screws or by conventional panel mount flanges located on the rear of the rear housing 20. The plug connector 40 can be mounted on the rear of a component to be assembled or on the end of a cable or cord. Alternatively, the male connector can be mounted in a stationary position and the female connector can be moved to mate with the stationary male connector. The two connectors can also be used to connect two wire harness, in which case both connectors would be free to move during mating. In other applications, one of the connectors can be mounted to a printed circuit board, with pcb pins extending up through the housing. This cam approach can also be used for sockets or connectors for mounting integrated circuit components or for ZIF pin grid array packages. For all of these applications a zero insertion force, low insertion force or reduced insertion force connection can be accomplished without the necessity of manipulating a separate cam actuator or lever. The spring biased contacts are deflected or spread apart simply as a result of inserting one connector into engagement with the other with movement being necessary only in one direction or along one mating axis.

We claim:

1. An electrical connector assembly comprising matable first and second electrical connectors, the first electrical connector including a molded housing with a molded latch engagable with the second electrical connector to latch the connectors in a mating position, the molded latch also including a camming surface for shifting a shiftable member of the first electrical connector relative to the molded housing as the first and second electrical connectors are mated; wherein the camming surface is located on an inner surface of the molded latch; wherein the shiftable member includes camming projections engagable with at least one terminal in the first connector molded housing; wherein the shiftable member comprises a second molded housing section mounted on the molded housing including the molded latch and wherein the molded latch extends from adjacent a rear end of the molded housing including the molded latch and the second molded housing section is located on a mating end spaced from the rear end.

2. The electrical connector assembly of claim 1 wherein the second molded housing section surrounds a portion of the molded housing including the molded latch.

3. The electrical connector assembly of claim 1 wherein the molded latch is located on the exterior of the second molded housing section.

4. An electrical connector having a front mating face and a rear face, the electrical connector comprising:

terminals having a deflectable spring contact section;

a rear housing including cavities in which the terminals are secured;

a front housing telescoping relative to the rear housing between a first forward and a second relative rearward position, the front housing having a front panel with a plurality of openings and camming projections on an interior surface of the front panel located adjacent the openings and facing rearward;

a movable camming member located adjacent to the front mating face of the connector, movement of the camming member bringing the camming member into engagement with the front housing and moving the front housing toward the second relative rearward position and toward the contacts to bring the camming projections into engagement with the spring contact sections to deflect the spring contact sections.

5. The electrical connector of claim 4 wherein the camming member comprises an arm molded as part of the rear housing and joined to the housing adjacent to the rear face of the connector.

6. The electrical connector of claim 5 wherein the camming member comprises a cantilever beam engagable with the front housing on a front free end of the cantilever beam.

7. The electrical connector of claim 6 wherein the camming member includes an inner projection and an outer projection on the front end of the cantilever beam, the inner projection engaging the front housing when deflected and the outer projection being positioned to engage a mating connector so that the camming member is deflected when the electrical connector is mated to the mating connector.

8. The electrical connector of claim 4 wherein the camming member is secured to the rear housing.

9. An electrical connector comprising:

a) a female component and a male component, said female and male components adapted for mating engagement with one another;

b) said male component comprising a molded housing having latching tabs on an exterior surface thereof and a plurality of male terminals positioned within said housing;

c) said female component comprising a first molded housing having a plurality of apertures, each aperture containing a female terminal therein;

d) said female component further comprising a second molded housing adapted for being secured to the first molded housing in a manner such that the second molded housing can move between forward and rearward positions relative to said first molded housing, said second molded housing having internal cam surfaces aligned with the apertures in the first molded housing, wherein upon movement of the second molded housing from said forward relative position to said rearward relative position, the cam surfaces engage to deflectable spring contact section on said female terminal;

e) said first molded housing further comprising external latching members having a first portion adapted to engage external cam surfaces on said second molded housing and a second portion adapted to engage the latching tabs on said male component, wherein upon actuation of said latching tabs, said latching members engage the external cam surface to move the second molded housing from the forward relative position to the rearward relative position, whereby said internal cam surfaces will contact the spring contact section of the female terminals and reduce the force needed to engage or disengage the male terminal from the female terminal.

10. The connector of claim 9, wherein the external latching members on said first molded housing comprise cantilever arms attached to a rear end of said first molded housing and having a free end located at a front edge of said first molded housing.

11. The connector of claim 10, wherein the first and second portions of said external latching members are located on opposite surfaces of the free end of the external latching members.

12. The connector of claim 9, wherein each female terminal is maintained within the aperture by a molded terminal latch in said first molded housing.

13. The connector of claim 9, wherein the external cam surface is located at a forward edge of said second molded housing.

14. The connector of claim 9, wherein the first molded housing is disposed within a cavity in the second molded housing.

15. The connector of claim 9, wherein the first portion of said external latching member comprises a cam surface.

16. The connector of claim 9, wherein the second portion of the external latching member comprises a detent that engages an opening in the male component when the female and male components are in a mated position, and which is engaged by the latching tabs to release the male and female components.

17. The connector of claim 9, wherein the latching tabs comprise cantilevered arms connected to a mating end of the male component and having a free end disposed in overlying relation a free end of the latching members on said first molded housing when the male and female components are in mated engagement.

* * * * *